United States Patent [19]

Kosugi et al.

[11] Patent Number: 4,757,289

[45] Date of Patent: Jul. 12, 1988

[54] FILTER WITH DIELECTRIC RESONATORS

[75] Inventors: Yuhei Kosugi; Shigeo Ogawa, both of Tokyo, Japan

[73] Assignee: NEC Corporation, Tokyo, Japan

[21] Appl. No.: 886,130

[22] Filed: Jul. 16, 1986

[30] Foreign Application Priority Data

Jul. 22, 1985 [JP] Japan ..... 60-160370

[51] Int. Cl.[4] ..... H01P 1/219; H01P 7/10

[52] U.S. Cl. ..... 333/209; 333/210; 333/232; 333/235

[58] Field of Search ..... 333/202, 204, 205, 208–212, 333/219, 227, 232, 235, 245, 246, 222–224

[56] References Cited

U.S. PATENT DOCUMENTS 4,121,181 10/1978 Nishikawa et al. ..... 333/202

4,423,397 12/1983 Nishikawa et al. ..... 333/202 X 4,578,655 3/1986 Etienne et al. ..... 333/202

*Primary Examiner*—Marvin L. Nussbaum

*Attorney, Agent, or Firm*—Sughrue, Mion, Zinn, Macpeak, and Seas

[57] ABSTRACT

A dielectric resonator filter applicable to any desired frequency which is required with a microwave band or a millimeter wave band communication apparatus is disclosed. A single base plate made of metal carries therewith a single or a plurality of dielectric resonators, a pair of input/output coupling members, and a pair of input/output connectors all of which are arranged directly on the base plate in a planar configuration. This base plate subassembly is shielded by a cover having a recess in a sectional view which serves as a cutoff range waveguide.

11 Claims, 5 Drawing Sheets

FILTER WITH DIELECTRIC RESONATORS

BACKGROUND OF THE INVENTION

The present invention relates to a filter with dielectric resonators which is suitable for use with a microwave band or a millimeter wave band communication apparatus.

Recently, a dielectric featuring a high Qo value and a small temperature coefficient of resonant frequency has been realized and in turn opened up a way toward practical use of a dielectric resonator filter which uses a low-loss ferroelectric as a $TE_{01}\delta$ mode resonator. Among various kinds of filters known in the art, most extensively used are bandpass filters. In the case of an electric resonator filter, a bandpass filter is achievable by arranging one or a plurality of dielectric resonators side by side in a cutoff waveguide. The distance between nearby resonators is so determined as to provide a predetermined coupling degree necessary for the configuration of a filter and requires considerable accuracy.

Attempts to put a dielectric resonator filter to practical use encounter various difficulties in technical aspect. Especially, many problems are left unsolved concerning the method of mounting dielectric resonators, the structure of a chassis and other mechanical arrangements.

SUMMARY OF THE INVENTION

It is therefore an object of the present invention to provide a dielectric resonator filter which is applicable to any desired frequency which an ordinary microwave communication apparatus requires.

It is another object of the present invention to provide a simple and cost-effective dielectric resonator filter.

It is another object of the present invention to provide a reliable and stable dielectric resonator filter.

It is another object of the present invention to provide a generally improved dielectric resonator filter.

A dielectric resonator filter of the present invention comprises a single flat base plate at least a surface of which is made of metal, a plurality of dielectric resonators arranged in an array on the surface made of metal at predetermined intervals, a pair of input/output coupling members arranged on the surface made of metal to face those of the dielectric resonators which are located at opposite ends of the array, and a cover mounted to the base plate and formed with a channel which constitutes a cutoff waveguide, the dielectric resonators and input/output coupling members being disposed in the channel.

The above and other objects, features and advantages of the present invention will become more apparent from the following detailed description taken with the accompanying drawings.

DESCRIPTION OF THE PREFERRED EMBODIMENT

To better understand the present invention, problems particular to prior art dielectric resonator filters will be discussed with reference to the drawings. A first problem is concerned with a method of fixing dielectric resonators.

Figure 1A:
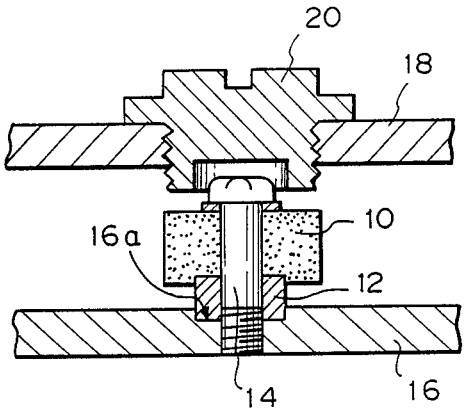
Fig. 1A PRIOR ART
FIGS. 1A and 1B are sections showing two typical examples of prior art methods of mounting a dielectric resonator in a dielectric resonator filter.
Figure 1B:
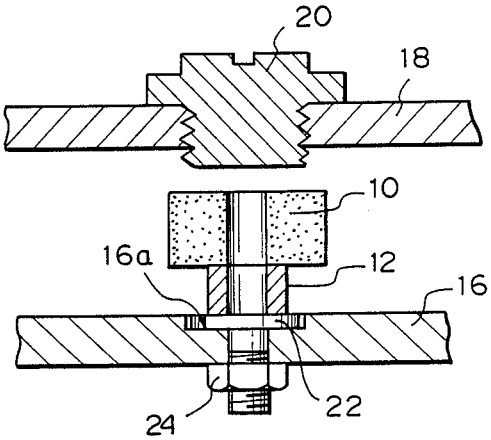
Fig. 1B PRIOR ART
Figure 2:
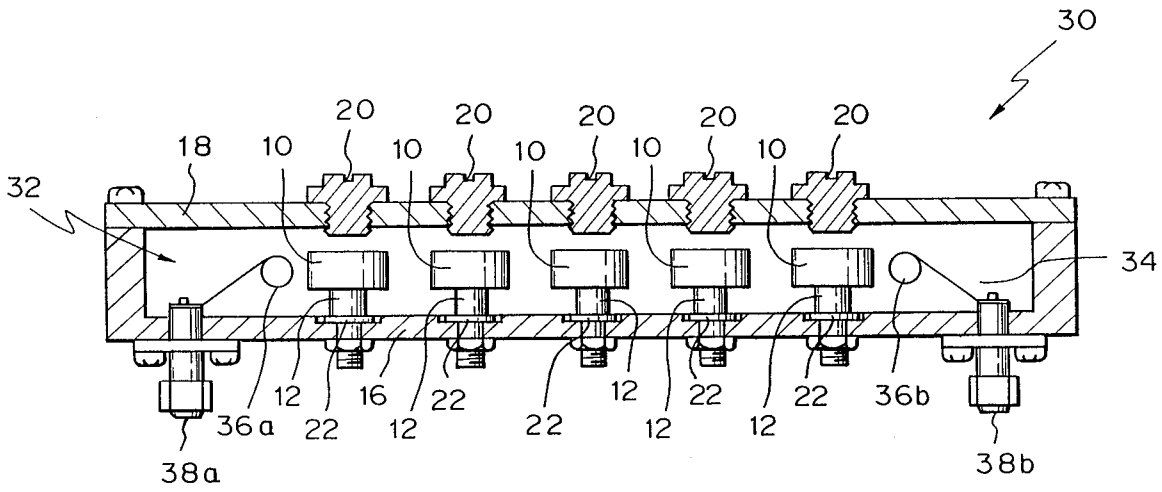
Fig. 2 PRIOR ART
FIG. 2 is a vertical section of a prior art dielectric resonator filter.

Specifically, FIGS. 1A, 1B and 2 each shows a typical example of methods of fixing dielectric resonators in a prior art dielectric resonator filter. What requires special consideration in constructing a dielectric resonator filter is as follows. Firstly, concerning mechanical stability, resonators should be prevented from being dislocated due to vibrations and impacts, otherwise resulting in fluctuation of filter characteristics. Secondly, as regards stability against temperature variations, dielectric resonators should be prevented from being dislocated or cracked due to temperature variations. Thirdly, as regards degradation of Qo, dielectric resonators should be located as remotely as possible from other dielectric materials which involve losses and metals which not only involve losses but also affect the resonant frequency.

In the filter shown in FIGS. 1A and 1B a dielectric resonator 10 is retained by a hollow cylindrical support 12. The support 12 is in turn received in a hole **16*a* which is formed in a chassis 16 while a plastic screw 14 is driven through the resonator 10 and support 12 into the shassis 16 to fix the former to the latter. A cover plate 18 which is associated with the chassis 16 is provided with a screw 20 adapted to adjust the resonant frequency. The plastic screw 14 is often made of polycarbonate. This kind of arrangement has various drawbacks: insufficient mounting strength, liability of the connecting portion between the support 12 and the chassis 16 move to dislocate the resonator 10 inside the chassis 16** and, thereby, make the filter characteristics unstable, etc.

In FIG. 2 which is representative of another typical prior art arrangement, the resonator 10 is fixed to the support 12 made of glass, ceramics or the like by, for example, diffusion of glass or by means of an adhesive. The support 12 is soldered to a flat mount 22 which is then passed throughout a mounting hole **16*a* formed in the chassis 16. Subsequently, a nut 24 is threaded over the tip of the mount 22 to fix the resonator 10 to the chassis 16. The fixing procedure allows the resonator to be fixed in place more positively than the procedure of FIG. 1A. However, it cannot avoid intricacy of construction since the resonator 10 is fitted to the mount 22 and, then, to the chassis 16**.

A drawback encountered with both of the configurations shown in FIGS. 1A and 1B is that the location of the resonator 10 inside the chassis 16 is permanently fixed. Usually, however, filters operable with various frequencies are required so that the intervals between the resonator 10 and nearby ones need be changed for each particular frequency. Hence, the structure of FIG. 1B which relies on the hole **16*a* formed through the chassis 16** is unsuitable for applications which require a filter adaptive to various different frequencies.

Referring to FIG. 2, a prior art dielectric resonator filter is shown and generally designated by the reference numeral 30. As shown, the filter 30 includes a cutoff waveguide 32 which is provided with a channel 34. Arranged in an array in the channel 34 are dielectric resonators 10. Input/output coupling members 36*a* and 36*b* are respectively located adjacent to opposite ends of the array of resonators 10. In this construction, a microwave signal enters the filter 30 via any one of input/output connectors 38*a* and 38*b* and, then, applied via the nearby input/output coupling member 36*a* or 36*b* to the resonator 10, which heads the array, so as to excite it. The wave sequentially propagated through all the resonators 10 is fed to the other input/output connector via the other input/output coupling member.

As shown and described, the prior art filter 30 has a plurality of dielectric resonators 10 arranged in an array in the narrow channel 34. Such a filter 30, therefore, cannot always be produced with ease.

Figure 3:
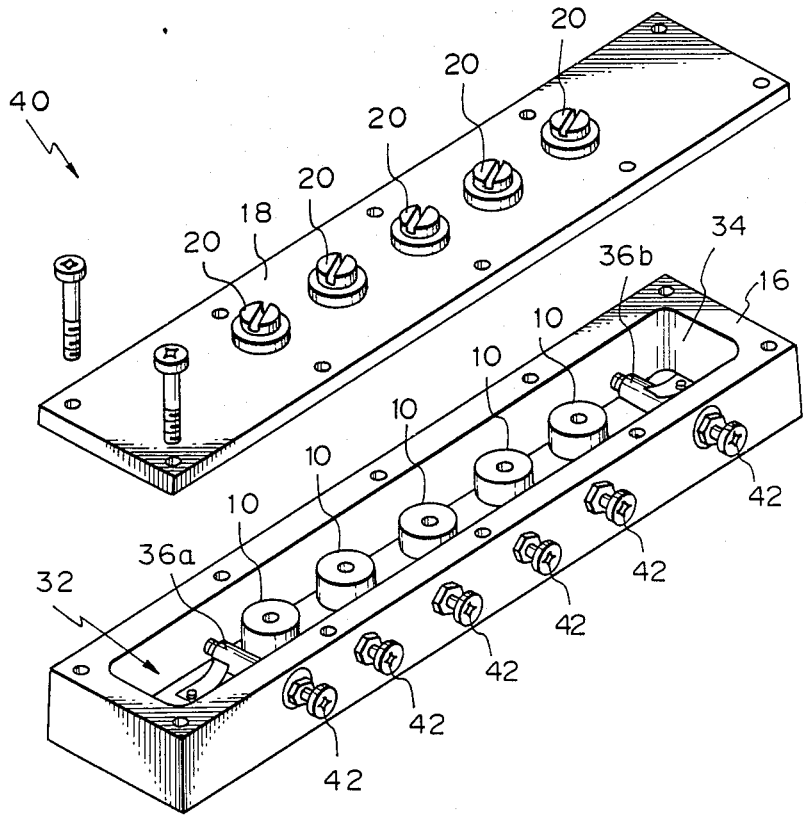
FIG. 3 is a perspective view of another prior art dielectric resonator filter which is shown with a cover plate removed.

Referring to FIG. 3, another prior art dielectric resonator filter is shown with a cover plate 18 thereof removed. FIG. 3 shows how the dielectric resonators 10 and input/output coupling members 36*a* and 36*b* are arranged in the chassis 16 which is provided with the channel 34. In this particular example, screws 42 adapted for the adjustment of coupling degree are mounted in the chassis 16.

To summarize the drawbacks of the prior art dielectric resonator filters as discussed above, the intervals between dielectric resonators are permanently fixed by mounting holes to make the filter hardly adaptive to different frequencies, and the assembly is troublesome due to the inherent structures.

Figure 4:
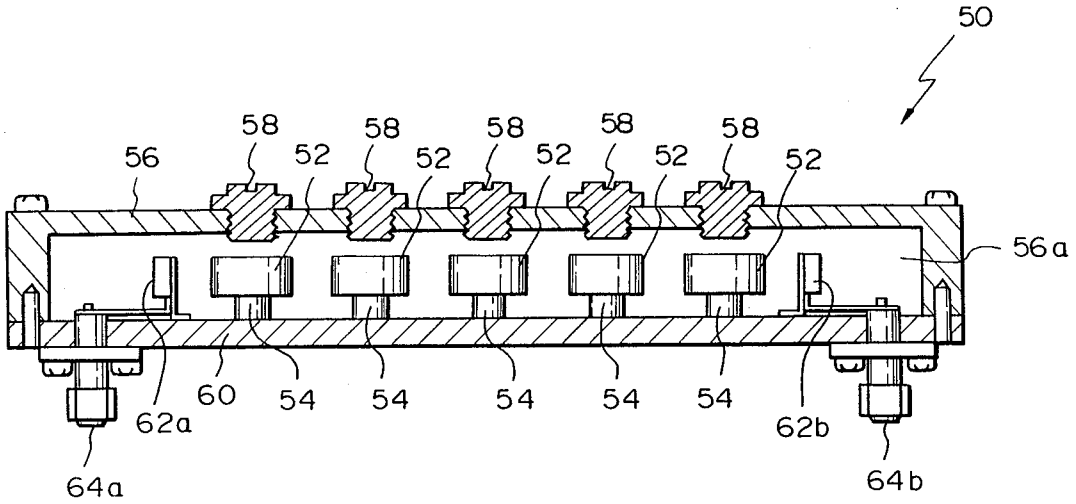
FIG. 4 is a vertical section showing a dielectric resonator filter in accordance with the present invention.

Referring to FIG. 4, there is shown a preferred embodiment of the present invention which is free from the drawbacks particular to the prior art filters as stated above. The dielectric resonator filter, generally 50, includes dielectric resonators 52 each being supported by a mount 54. While the mount 54 is made of ceramics, plastics or like dielectric material, it is preferable to select a material having a small tan $\delta$ value (dielectric dissipation factor) in order to suppress loss. Adjusting screws 58 adapted for fine adjustment of resonant frequency are mounted in a base cover 56 of the filter 50. Each screw 58 is rotatable to move up and down relative to the base cover 56 so as to change the resonant frequency. the resonators 52 are directly mounted on a base plate 60 through their associated mounts 54, at least the surface of the base plate 60 being made of metal. Any of an adhesive or a solder may be utilized to connect the resonators 52 to the base plate 60. A pair of input/output coupling members 62*a* and 62*b* are also directly mounted to the base plate 60 and, preferably, by spot welding, ultrasonic welding or like technology. Each of the coupling members 62*a* and 62*b* is formed by bending a thin sheet adequately. The cover 56 having the channel 56*a* which serves as a cutoff waveguide is mounted to the base plate 60 in such a manner as to cover the resonators 52 and the coupling members 62*a* and 62*b*.

Figure 5:
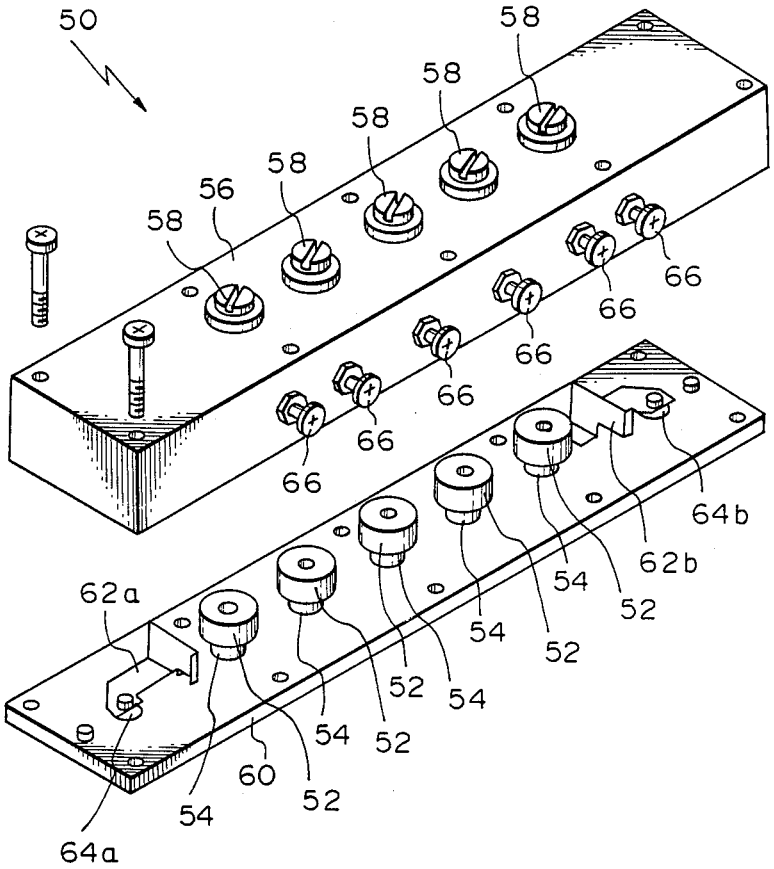
FIG. 5 is a perspective view of the filter of FIG. 4 which is shown with a cover removed.

The filter 50 in accordance with the present invention is shown in FIG. 5 with the cover 56 removed. As shown, input/output connectors 64*a* and 64*b* are mounted on the base plate 60. These connectors 64*a* and 64*b*, input/output coupling members 62*a* and 62*b* and dielectric resonators 52 which constitute essential structural elements of the filter 50 and need accuracy are mounted in a planar configuration on the base plate 60. Further, screws 66 for adjusting coupling degree are threaded in the cover 56. The filter assembly 50 is completed by fixing to the base plate subassembly to the cover 56 which is provided with the channel-like cutoff waveguide thereinside. It is to be noted, however, that the screws 58 and 66 on the cover 56 do not constitute any essential part of the filter 50.

As described above, the dielectric resonator filter in accordance with the present has the input/output connectors 64*a* and 64*b*, input/output coupling members 62*a* and 62*b* and dielectric resonators 52 all of which are mounted in a planar configuration on the single base plate 60. Due to the planar configuration, the resonators 52 can be located and adhered with accuracy by an exclusive positioning instrument. In the prior art filter structures, it is impossible to use a positioning instrument since resonators must be manipulated within the narrow channel-like waveguide. In contrast, in accordance with the present invention, the resonators 52 can be located in any desired positions by means of a positioning instrument, i.e., at any desired intervals which matches with a desired frequency in a given frequency band.

Further, even the input/output coupling members 62*a* and 62*b* and input/output connectors 64*a* and 64*b* are arranged integrally with the single base plate 60, causing assembling work which needs accuracy to concentrate on the base plate 60. The operations on the base plate 60 may be accomplished by a semiautomatic or a fully automatic assembling machine. An automatic assembling machine can be implemented with ease due to the operations performed on the planar configuration. It is almost impossible for any of the prior art filters to be assembled by an automatic machine since the chassis, dielectric resonators and input/output coupling members all of which have critical influence on the accuracy are arranged three-dimensionally. The assembly of the filter 50 in accordance with the present invention is completed by fixing the cover 56 to the base plate 60.

The advantages of the filter 50 as shown and described may be summarized as enumerated below.

(1) Because the dielectric resonators 52, input/output coupling members 62*a* and 62*b* and input/output connectors 64*a* and 64*b* are located and mounted in a planar configuration, assembling steps which are essential and need accuracy are integrated.

(2) Due to the planar structure, a space for the operation of an automatic assembling machine is available as desired. Automatic assembly would cut down the cost of the filter while further enhancing the accuracy.

(3) Because the positions of the dielectric resonators 52 in the filter 50 are freely variable, any desired frequency within a predetermined frequency band can be implemented with the same hardware.

(4) Directly adhering, brazing or otherwise fixing the dielectric resonators 52 to the base plate 60 eliminates intermediaries and, thereby, increases the resonant frequency accuracy and, yet, enhances stability.

Various modifications will become possible for those skilled in the art after receiving the teachings of the present disclosure without departing from the scope thereof.

What is claimed is:

1. A dielectric resonator filter comprising:

a single flat base plate at least a surface of which is made of metal;

a plurality of dielectric resonators arranged in an array on said surface made of metal at predetermined intervals;

a pair of input/output coupling members each formed of a bent thin sheet and arranged on said surface made of metal to face those of said dielectric resonators which are located at opposite ends of said array, said input/output coupling members being mounted such that a surface thereof which electromagnetically couples with a dielectric resonator is perpendicular to said flat base plate; and a cover mounted to said base plate and formed with a channel which constitutes a cutoff waveguide, said dielectric resonators and input/output coupling members being disposed in said channel.

2. A dielectric resonator filter as claimed in claim 1, further comprising a pair of input/output connectors which are respectively connected to said input/output coupling members and mounted on said base plate to be received in said channel.

3. A dielectric resonator filter as claimed in claim 2, wherein each of said dielectric resonators is held by a support member having a small tan δ value and which is connected to said surface which is made of metal.

4. A dielectric resonator filter as claimed in claim 3, wherein said support member is made of a dielectric material having a small dielectric dissipation factor.

5. A dielectric resonator filter as claimed in claim 1, further comprising screws arranged on said cover and in alignment one with each of said dielectric resonators for adjusting resonant frequency.

6. A dielectric resonator filter as claimed in claim 5, further comprising a pair of input/output connectors which are respectively connected to said input/output coupling members and mounted on said base plate to be received in said channel.

7. A dielectric resonator filter as claimed in claim 6, wherein each of said dielectric resonators is held in a support member having a small tan δ value and which is connected to said surface which is made of metal.

8. A dielectric resonator as claimed in claim 7, wherein said support member is made of a dielectric material having a small dielectric dissipation factor.

9. A dielectric resonator filter comprising:

a single flat base plate at least a surface of which is made of metal;

a plurality of dielectric resonators arranged in an array on said surface made of metal at predetermined intervals; a pair of input/output coupling members each formed of a bent thin sheet and arranged on said surface made of metal to face those of said dielectric resonators which are located at opposite ends of said array, said input/output coupling members being mounted such that a surface thereof which electromagnetically couples with the dielectric resonator is perpendicular to said flat base plate; and a cover mounted to said base plate and formed with a channel which constitutes a cutoff waveguide, said dielectric resonators and input/output coupling members being disposed in said channel;

wherein each of said dielectric resonators is held by a support member having a small tan δ value and which is connected to said surface which is made of metal.

10. A dielectric resonator filter as claimed in claim 9, wherein said support member is made of a dielectric material having a small dielectric dissipation factor.

11. A dielectric resonator filter as claimed in claim 10, further comprising screws arranged on said cover and in alignment one with each of said dielectric resonators for adjusting resonant frequency.

* * * * *

UNITED STATES PATENT AND TRADEMARK OFFICE
CERTIFICATE OF CORRECTION

PATENT NO. : 4,757,289
DATED : July 12, 1988
INVENTOR(S) : Kosugi et al

It is certified that error appears in the above-identified patent and that said Letters Patent is hereby corrected as shown below:

COLUMN 2, LINE 35 Delete "shassis" insert --chassis--;

COLUMN 2, LINE 62 After "fixed" insert --This is no problem insofar as the frequency of the filter is fixed.--

Signed and Sealed this

Tenth Day of January, 1989

*Attest:*

DONALD J. QUIGG

*Attesting Officer*

*Commissioner of Patents and Trademarks*